US005551383A

United States Patent [19]

Novotny

[11] Patent Number: 5,551,383

[45] Date of Patent: Sep. 3, 1996

[54] INTERNAL COMBUSTION ENGINE UTILIZING PISTONS

[76] Inventor: Rudolph J. Novotny, 1879 NW. River Trail, Stuart, Fla. 34994

[21] Appl. No.: 505,407

[22] Filed: Jul. 20, 1995

[51] Int. Cl.[6] ..... F02B 75/28

[52] U.S. Cl. ..... 123/51 BD; 123/56.9; 123/47 R

[58] Field of Search ..... 123/51 BD, 56.9, 123/42 R, 46 R, 51 B, 56.8, 56.2, 55.6, 55.7

[56] References Cited

U.S. PATENT DOCUMENTS

| | | | |
|---|---|---|---|
| 3,456,630 | 7/1969 | Karlan | 123/56.9 |
| 4,732,115 | 3/1988 | Lapeyre | 123/51 BD |
| 4,996,953 | 3/1991 | Buck | 123/56.9 |
| 5,031,581 | 7/1991 | Powell | 123/56.9 |
| 5,375,567 | 12/1994 | Lowi | 123/56.9 |

*Primary Examiner*—Marguerite McMahon
*Attorney, Agent, or Firm*—Norman Friedland

[57] ABSTRACT

An internal combustion engine having a cylindrical outer case(s) defining a base compression cylinder(s) with an inner cylindrical cylinder(s) defining power cylinder(s) circumferentially spaced in the engine and each housing opposing intake and exhaust pistons. Inlet ports for supplying pressurized air to the pistons included a small percentage of base compression air stored in an accumulator at a pressure that is the highest pressure in the engine. Flex tubes judiciously mounted in the piston and attached at either end to the piston and piston ring for supplying air from the accumulator to a plurality of pockets formed in the piston ring to hydrostatically support the pistons and piston rings. The pistons power a rotary cam mounted on opposing ends of the engine and a cam follower system positions the pistons for the 2-cycle operation. A four bar linkage system operatively connected to the piston rod to minimize piston side loads. The passage between the power cylinder and base compression cylinder serves to admit heated air, indirectly heated during the combustion cycle, charges the power cylinder for improved efficiency. The absence of the block and the material used for the hot section of the engine are made from relatively light weight materials providing a significantly improved power to weight ratio.

41 Claims, 14 Drawing Sheets

INTERNAL COMBUSTION ENGINE UTILIZING PISTONS

TECHNICAL FIELD

This invention relates to reciprocating internal combustion engines and particularly to an advanced version that eliminates side loadings, utilizes a coannular power cylinder and base compression cylinder assembly, opposing intake and exhaust pistons, piston rings that are cooled and hydrostatically lubricated by air, and incorporates a relatively high temperature cylinder wall which engine is hereinafter referred to as the Novotny engine.

BACKGROUND ART

As is well known, diesel, gas and steam engines of the reciprocating type typically convert the linear piston motion into rotary motion by utilizing piston(s), connecting rod, and crankshaft. This conversion process obviously creates a substantial piston side load which requires oil lubrication to control friction and wear of the piston skirt and cylinder and a substantial and heavy engine case. To prevent oil breakdown and loss of lubricity the cylinder wall and piston side walls and rings generally are maintained at a temperature that is below a maximum of 350 degrees Fahrenheit. Typically, these engines must incorporate a cooling system that serves to reject at least 25 percent of the total heat energy which is dissipated into the ambient air which energy would otherwise provide shaft horsepower.

As will be described in more detail hereinbelow, the Novotny engine, unlike what is shown in the prior art, floats the piston in the cylinder with a cushion of air by absorbing the side loads that would otherwise load the pistons at locations remote from the piston. Unique to the engine of this invention is the use of curved air feed flexible tubes made from a compliant material that 1) keep the piston ring concentric to the piston and 2) supply air in choked flow (Mach 1) to the integral piston ring depressions to hydrostatically compress the piston ring relative to the cylinder and continuously float the piston and piston ring on pockets of compressed air. The Novotny engine utilizes an accumulator for the purpose of storing base compression air which is raised to a pressure higher than the maximum combustion pressure manifested by the piston operation for use in the lubrication and floating of the piston.

Of interest in this type of engine is U.S. Pat. No. 5,375,567 granted to A. Lowi, Jr. on Dec. 27, 1994, which discloses a two-stroke-cycle engine that requires no cooling and utilizes twin double-harmonic cams that claim to balance reciprocating and rotary motion at all loads and speeds so as to obviate all side loads. As will be more fully detailed hereinbelow, the present invention makes no claim to the ability of operating without lubrication, Although the Novotny engine does not require oil as a lubricant for the pistons as is the case for most piston engines and while it utilizes a quasi-type of twin double-harmonic loads, it utilizes a four bar linkage system to enhance the elimination of the side loads.

Other patents that utilize opposing pistons and harmonic types of cams but do not incorporate a linkage system for minimizing or eliminating side loads are U.S. Pat. No. 2,076,334 granted to E. B. Burns on Apr. 6, 1937, and U.S. Pat. No. 1,788,140 granted to L. M. Woolson on Jan. 6, 1931.

Also disclosed in the prior art are a number of patents that utilize a gas for lubrication rather than oil. For example, U.S. Pat. No. 4,455,974 granted to Shapiro et al on Jun. 26, 1984, utilizes gases generated in the engine to hydrostatically support the piston rings. Similarly, U.S. Pat. No. 4,681,326 granted to I. Kubo on Jul. 21, 1987, utilizes engine gasses to support the piston rings.

U.S. Pat. No. 4,111,104 granted to Davison, Jr. on Sep. 5, 1978, utilizes engine gases to support the piston and U.S. Pat. No. 3,777,722 granted to K. W. Lenger on Dec. 11, 1973, support a ringless piston with air for reducing friction.

SUMMARY OF THE INVENTION

An object of this invention is to provide an improved piston engine having opposed pistons that eliminates side loads and oil as the lubricant for the pistons. The customary valving utilized in internal combustion engines is eliminated and the intake and exhaust pistons vary the area from full open to full close of the inlet and exhaust ports.

In particular this engine captures the lost heat energy by having the trapped base compression air, which is located around the combustion cylinder, absorb this energy prior to scavenging and recharging the cylinder with this new air charge and thereby, reducing the quantity of fuel required to heat the air and provide the shaft horsepower.

A feature of this invention is to eliminate the cylinder head and/or valves. Not only does this obviate the necessity of requiring lubrication, it also minimizes emissions and energy heat loss. Rather this invention incorporates opposed pistons that move apart and together equally which provides a large expansion ratio with half the piston speed and the associated acceleration loads that would otherwise occur with a single piston and cylinder head design.

Another feature of this invention is the incorporation of the combined 3-dimensional power cams (quasi-harmonic cam) and the four bar linkages associated with each piston. Not only do the opposed 3-dimensional power cams of this invention have a high mechanical advantage because of the large radial location of the piston roller bearing cam surface and the constant 45 degree ramp angle on the cam surfaces during piston compression and expansion motion, they also permit the two piston axi-symmetric cycles per shaft revolution which increases torque at a reduced shaft RPM. Piston movement is minimized during fuel injection and combustion completion to approach optimum efficiency constant volume combustion. The slope of the cam during compression and expansion is 45 degrees for equalizing the thrust and tangential loads on the cam face so as to minimize bearing friction.

The combined power cam arrangement and four bar linkages per piston minimize or eliminate side loads since the piston loads are reacted through the rotating power shaft and cams with no shaft bending moments or power shaft bearing loads and consequently, these loads do not pass through the static structure permitting a light weight engine with potential applications for aircraft. The four bar linkages assembly locate the piston large bearing pin to the static structure while guiding the pin in a straight line motion over the piston assembly stroke. The low friction revolute motion of the needle bearing linkage may be lubricated with a boundary type lubrication which significantly reduces energy loss from friction. Since the oil is remote from the combustion chamber, the requirement for oil changes is eliminated and this arrangement replaces the high friction piston skirt and rings rubbing in the cylinder.

Another feature of this invention is the utilization of pressurized air from an external source for engine start-up and base compression air that is judiciously applied to the piston rings that support and center the piston and piston rings so as to avoid contact with the cylinder wall and hence, lubricate and cool the cylinder obviating the necessity of providing other cooling means and the attendant accessories such as cooling hoses and radiators. Because of this arrangement, it now becomes practical to utilize a thermal barrier coating on the power cylinder inside surface and piston top which would further improve the thermal efficiency by minimizing combustion heat loss.

A still further feature of this invention is the modification of the engine cycle to supercharge or turbocharge the engine by changing the slope of the power cam so that the port opening and closing by the pistons will be different when the intake and exhaust pistons move toward and away from each other.

Another feature of this invention is the modular construction including the coannular power cylinders and base compression cylinders disposed between the static end plates without the use of a block for providing a low weight construction.

The foregoing and other features of the present invention will become more apparent from the following description and accompanying drawings.

DETAILED DESCRIPTION OF THE PREFERRED EMBODIMENT

The preferred embodiment of the Novotny engine is designed to have a fuel air ratio of 0.035 so as to provide smokeless operation at a power setting of 1085.0 horsepower at 3000 RPM and be within the current emissions requirements. The engine displacement is 1220 cubic inches per revolution with an overall engine size of only 26.0 inches in diameter and 5.0 feet long. The engine is void of belt driven accessories or cooling hoses and radiators.

In its preferred embodiment, the Novotny engine as described herein is configured with six cylinders and twelve pistons and each paired diametrically opposed piston sets are compressing and expanding axi-symmetrically, so as to minimize or eliminate unbalance or out of plane loads at any time during the engines operating envelope for providing a relatively vibration free engine. Since each piston set "fires" twice per output shaft revolution, it produces twice the torque at half the shaft RPM. While this invention is described in the preferred embodiment to include specific parameters, it will be appreciated by one skilled in this art that other parameters including the number of pistons and attendant cylinders could be utilized without departing from the scope of this invention. It will be appreciated that two opposing pistons in a single cylinder will constitute the minimum number of pistons and cylinders.

To fully appreciate and understand this invention and for the sake of convenience and simplicity this disclosure is divided into separate distinctive topics which are, namely, 1) OVERVIEW OF THE ENGINE;
2) ENGINE'S OPERATING CYCLE;
3) THE HYDROSTATIC BEARINGS;
4) THE FOUR BAR LINKAGE SYSTEM; AND

5) THE COANNULAR POWER CYLINDER AND BASE COMPRESSION CYLINDER ASSEMBLY

OVERVIEW OF THE ENGINE

Figure 1:
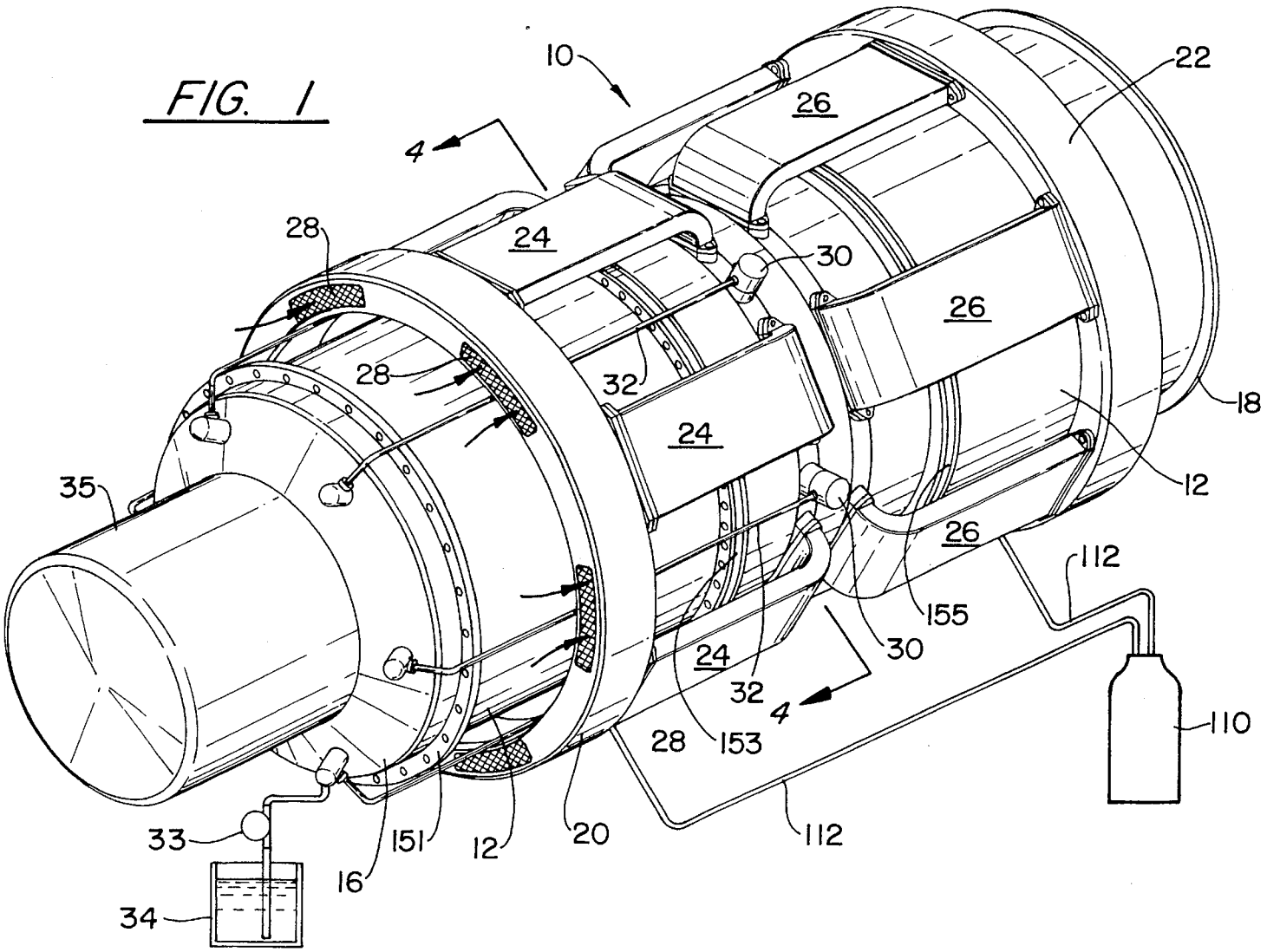
FIG. 1 is a perspective view and schematic of the assembled engine.

Referring to FIG. 1 which is a perspective view of the Novotny engine generally indicated by reference numeral 10 which is comprised of a modular cylindrical engine outer case 12 assembly supporting the rotary shaft 14 for rotation about the engine's axis A. The modular construction will be detailed in the coannular power cylinder and base compression cylinder assembly topic. Shaft 14 as noted in FIG. 2 extends outwardly from the fore end 16 and the aft end 18 Surrounding the engine case 12 are inlet manifold 20 and exhaust manifold 22 which are in communication with the intake pistons and exhaust pistons, respectively, through a plurality of inlet conduits 24 and exhaust conduits 26 equally and circumferentially spaced around the engine case 12. As will be described in greater detail hereinbelow, the inlet ports 28 disposed in the inlet manifold 20, which may include a suitable filter, lead fresh ambient air into the piston cylinders and the exhaust ports (not shown) disposed in the exhaust manifold 22 discharge the spent combusted products to ambient.

Fuel is admitted to the cylinders through the fuel nozzle injectors 30 which is fed fuel under pressure through fuel line 32. Fuel from a fuel reservoir 34 is pressurized in a well known manner from suitable injector pump(s) schematically shown by reference 33. The pumps 33 would typically be supported in the accessory case 35 suitably supported to engine case 12 and the power for driving the pumps would be extracted from the rotary shaft 14. In the preferred embodiment the accessories would be powered by the portion of shaft 14 that extends from the fore end 16 and the power for driving the load would be extracted from the shaft extending from the aft end 18. This is, of course, optional as the power for either the accessories or load may be extracted at either end of shaft 14. It will be understood that the load that the engine drives would include without limitation, passenger cars, land vehicles, aircraft and water vehicle propellers, auxiliary power units, generators, earth moving vehicles and the like.

Figure 4:
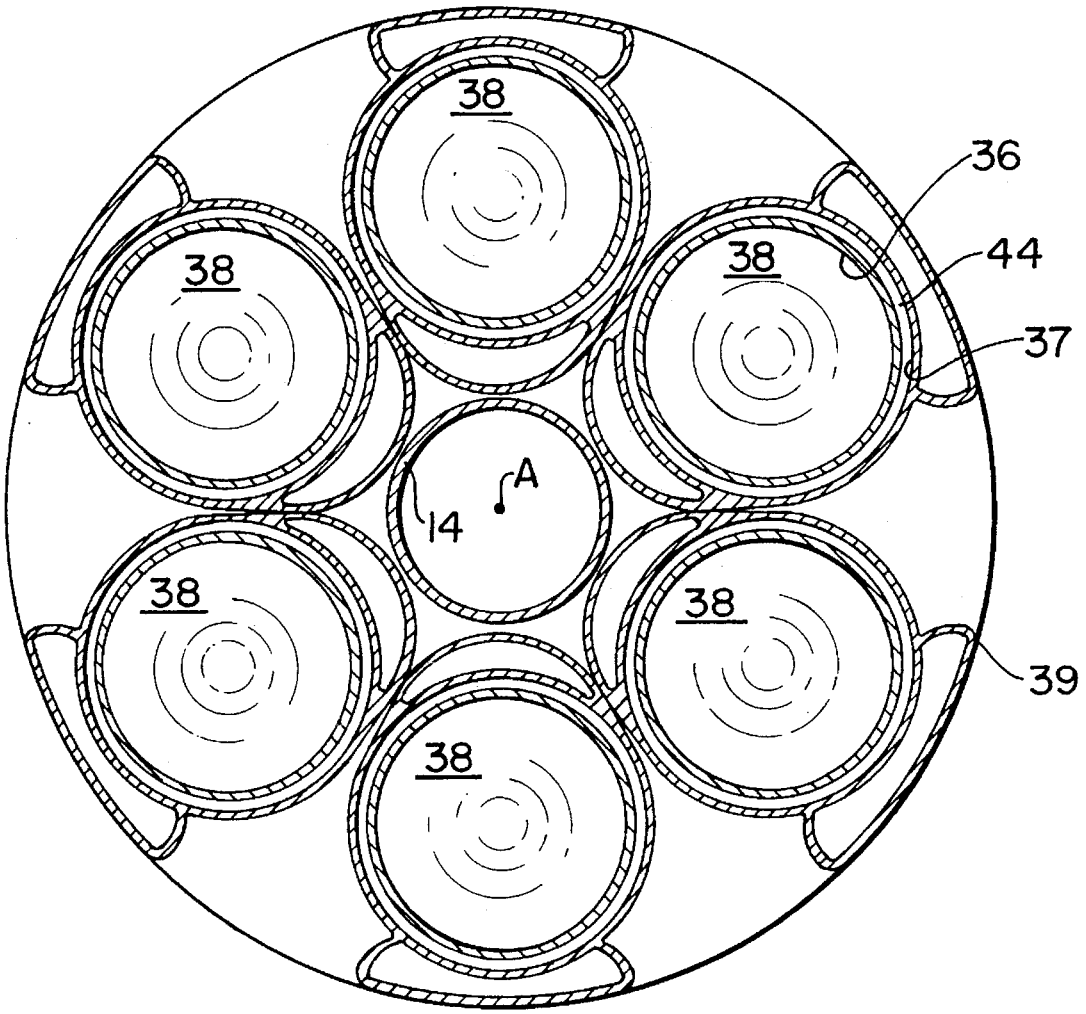
FIG. 4 is an end view illustrating the six power cylinders and six complementary base compression cylinders assemblies with the central power shaft.
Figure 5:
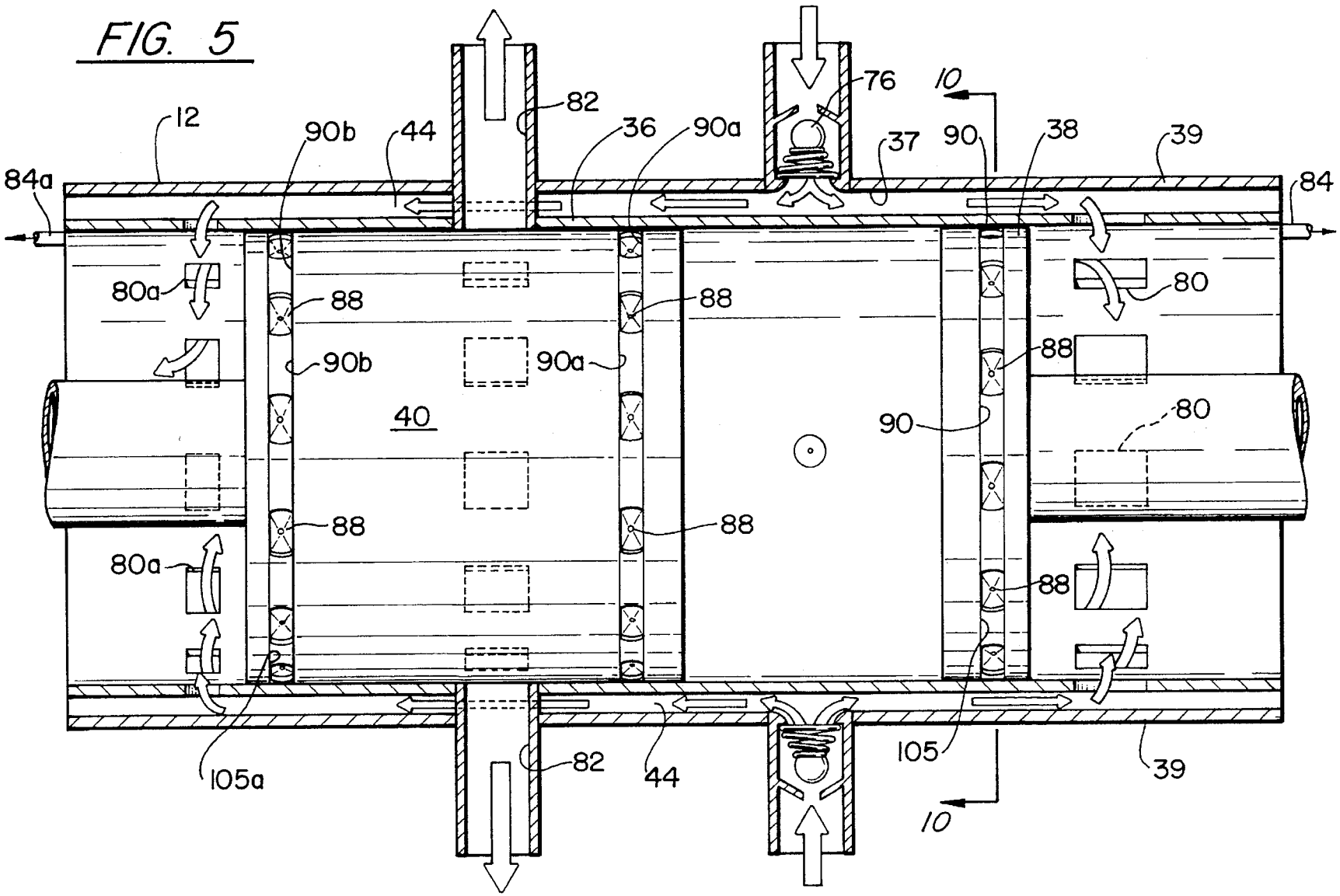
FIG. 5 is a sectional view of a single power cylinder and piston assembly.
Figure 6:
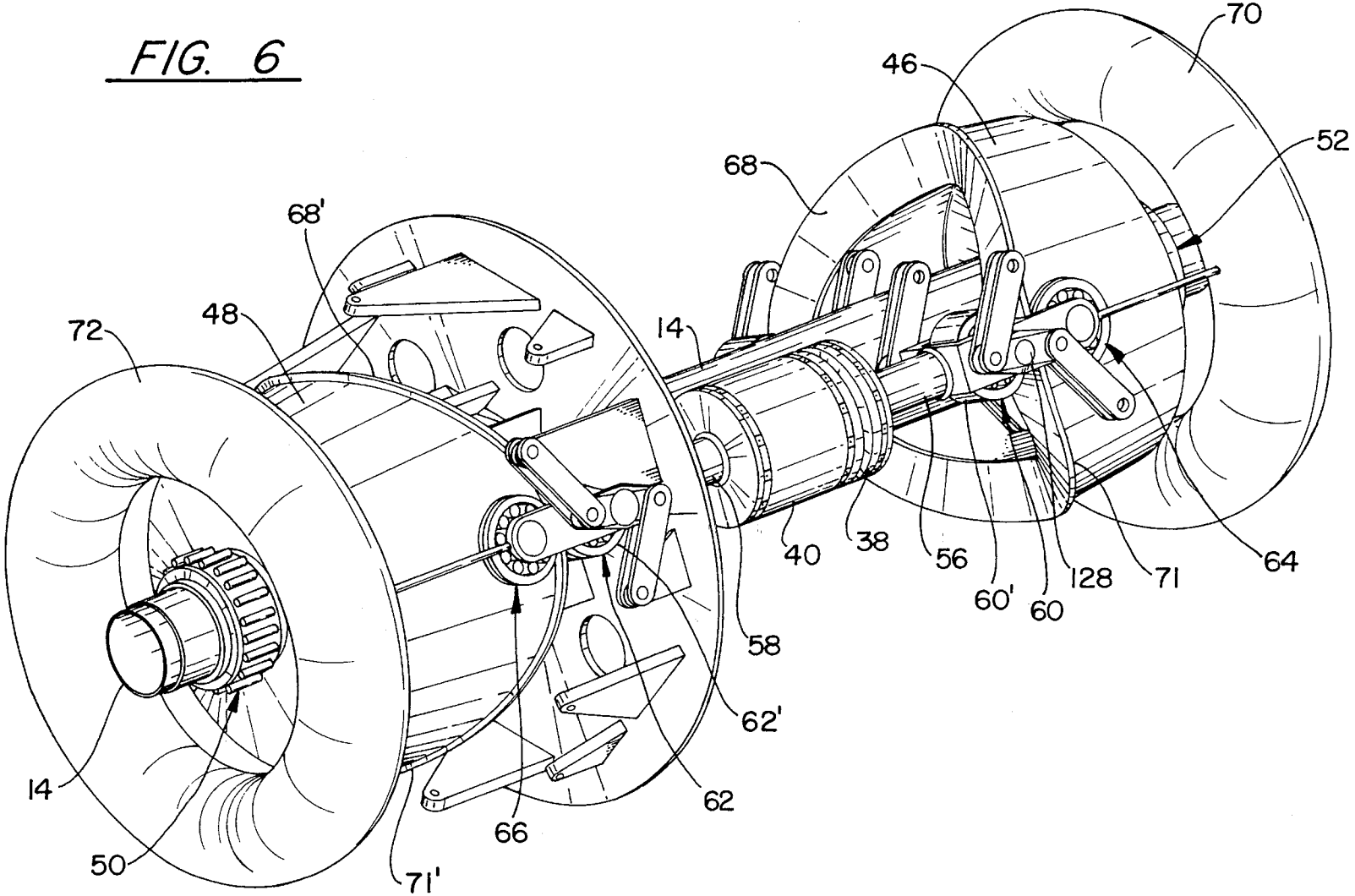
FIG. 6 is a partial view in perspective illustrating a pair of sets of opposing intake and exhaust pistons and a four bar linkage system and power cams and engine main bearings with the engine case and the end plate and exhaust piston assemblies on one side removed.
Figure 7:
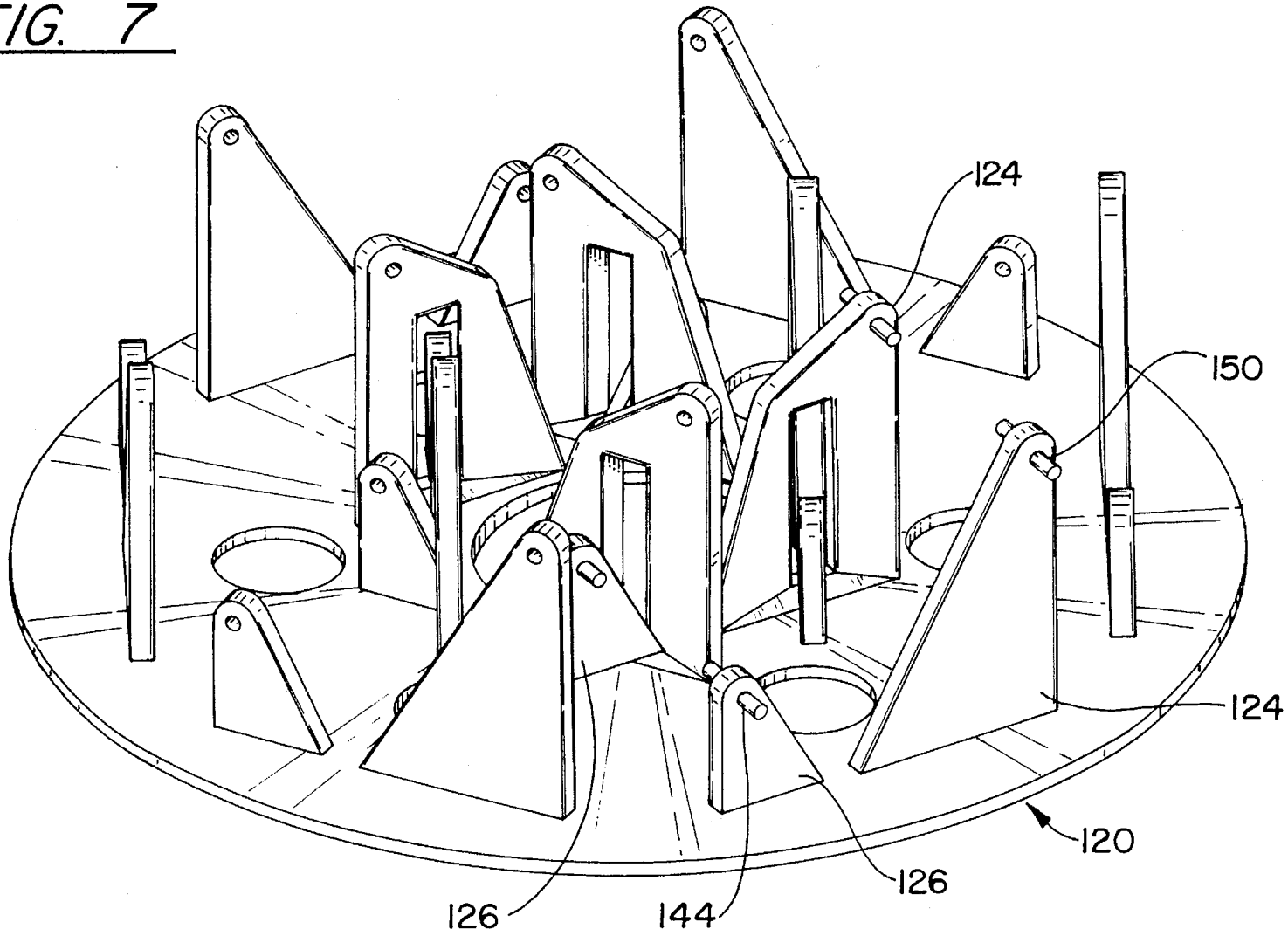
FIG. 7 is a perspective view of one of the static structure end plates that support the four bar linkage systems.

Referring next to FIGS. 2–10, and as best seen in FIG. 4, which is a sectional view taken along lines 4—4 of FIG. 1, the Novotny engine includes six (6) equally and circumferentially spaced power cylinders 36 disposed in an equal number of complementary base compression cylinders 39 that are concentric relative to each other and coaxial relative to shaft 14 (axis A). The power cylinders 36 support twelve (12) pistons therein, namely six (6) intake pistons 38 opposing six (6) exhaust pistons 40. As best seen in FIGS. 4 and 5 the power cylinder 36 which is concentrically mounted in the base compression cylinder 39 includes the base compression cylinder surface 37 that is spaced from the outer surface of power cylinder 36 to form an annular passageway 44, the purpose of which will be described in detail hereinbelow.

Shaft 14 connects to and rotates with the opposing power cams 46 and 48 (FIGS. 3, 4 and 6) which are located concentrically and axially within the engine case 12 by suitable roller bearing 50 and thrust ball bearing 52. Shaft 14 is driven by the intake pistons 38 and exhaust pistons 40 via the connecting rods 56 and 58, respectively that are operatively connected to the large roller bearings 60 and 62 respectively and small roller bearings 64 and 66 respectively. The large roller bearings 60 and 62 roll on the faces 68 and 68' of the power cams 46 and 48 to cause them to rotate around the axis A when the heated air in the power cylinder pushes the intake piston 38 and exhaust piston 40 apart to initiate the cycle toward top dead center and the small roller bearings 64 and 66 rolling on the faces of lips 71 and 71' of the power cams 46 and 48 respectively to actuate the intake piston 38 and exhaust piston 40 to assist in pulling the intake piston 38 and exhaust piston 40 to the end of the bottom dead center of the stroke. The intake piston 38 and exhaust piston 40 are then pushed together by the large bearings 60 and 62 rolling on the faces 68 and 68'. Under certain conditions the large bearings 60 and 62 may have sufficient energy to position the intake piston 38 and the exhaust piston 40 the full travel of the stroke. In other conditions the small bearings may have to assist to position the intake and exhaust pistons to bottom dead center. The faces 68 and 68' of the power cams 46 and 48 are suitably contoured to a slightly larger radius than the large bearings 60 and 62 outer race surfaces 60' and 62' so that the bearing outer race will hydroplane on the cam surface and prevent metal to metal contact.

A pair of toroidally shaped air tanks which define accumulators 70 and 72 are disposed at the aft end 18 and fore end 16 and serve to collect and store a small percentage of base compression air to be utilized for supplying pressurized air to the hydrostatic air bearings. This aspect of the invention will be discussed in more detail in the Hydrostatic Bearing topic.

ENGINE'S OPERATING CYCLE

Figure 8:
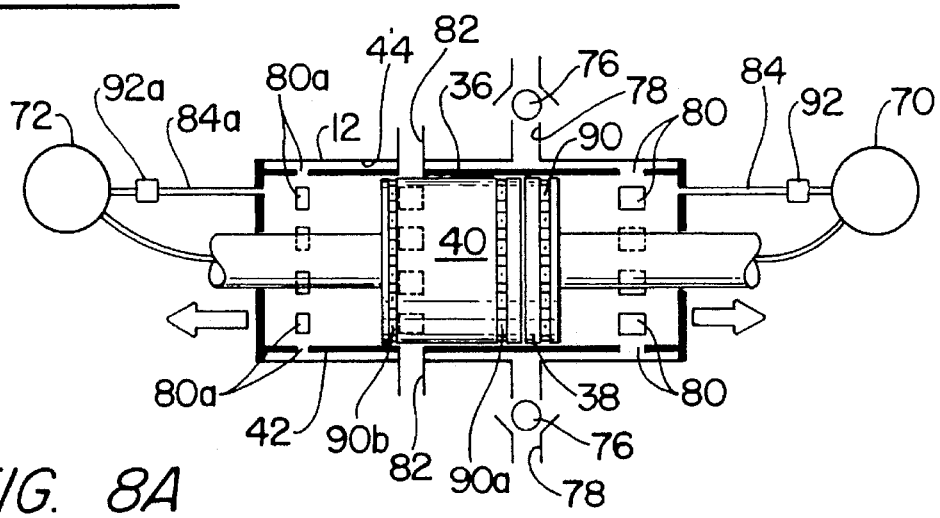
FIG. 8 is a schematic view showing the power cylinder and opposing intake and exhaust pistons assembly in the combustion position of the power cycle and compression cycle with full charge base compression.
Figure 8A:
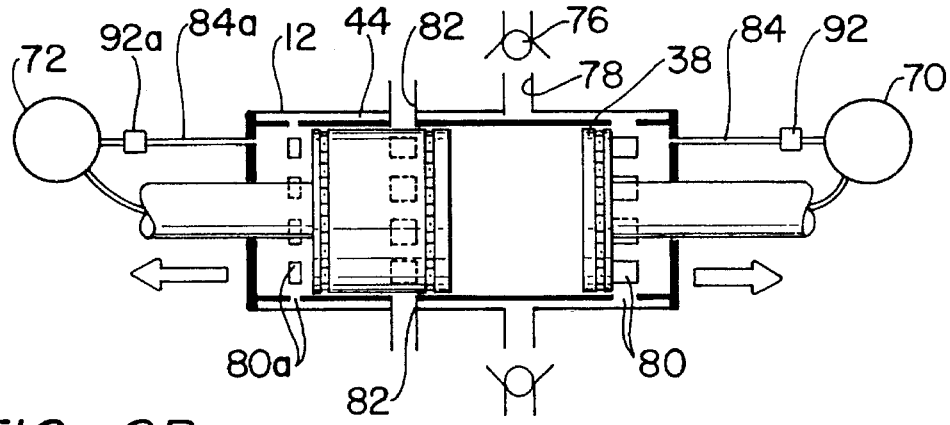
FIG. 8A is a schematic view showing the power cylinder and opposing intake and exhaust pistons assembly in the expanded position of the power cycle and partial compression of base compression air into annulus around the outside of the power cylinder.
Figure 8B:
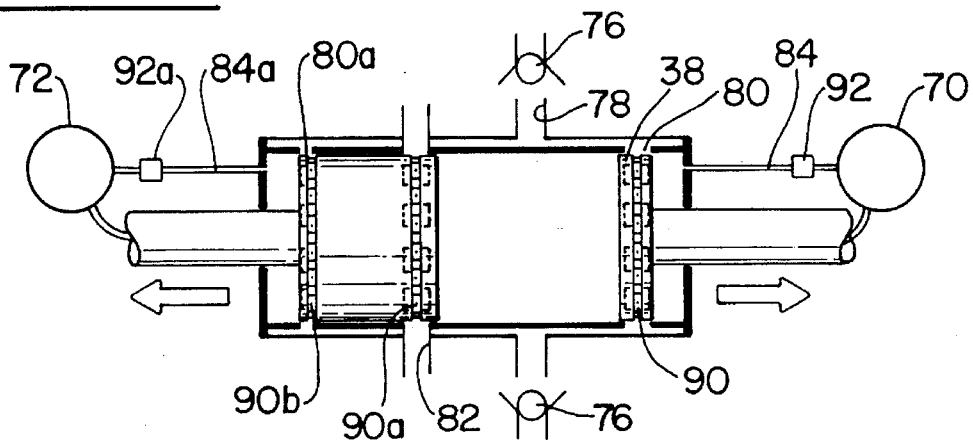
FIG. 8B is a schematic view showing the power cylinder and opposing intake and power pistons assembly in initiating port opening position of the power cycle and start of compression of air bearing piston ring air into air reservoirs.
Figure 8C:
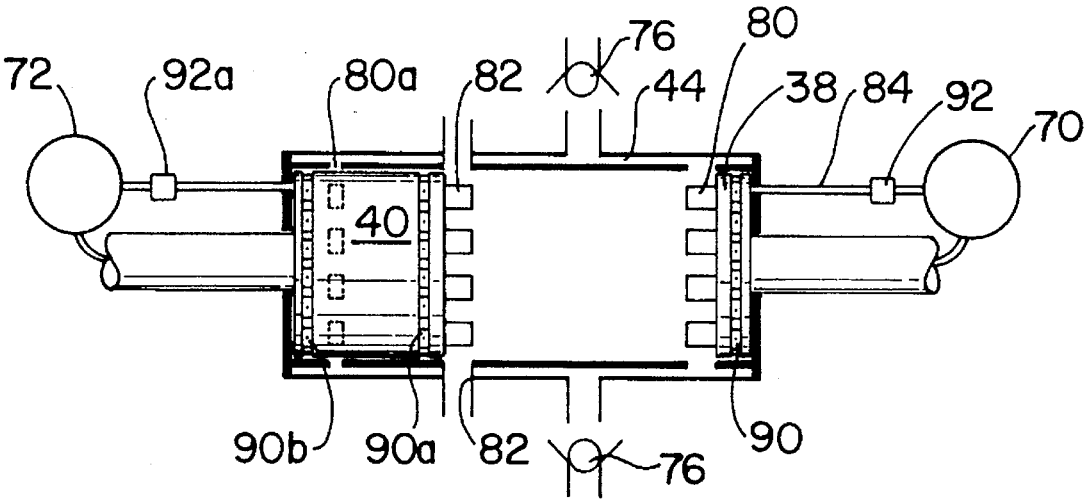
FIG. 8C is a schematic view showing the power cylinder and opposing intake and exhaust pistons assembly in base compression air flow purging position of the power cycle and completion of compression of air bearing piston ring air into the piston ring air reservoir.
Figure 8D:
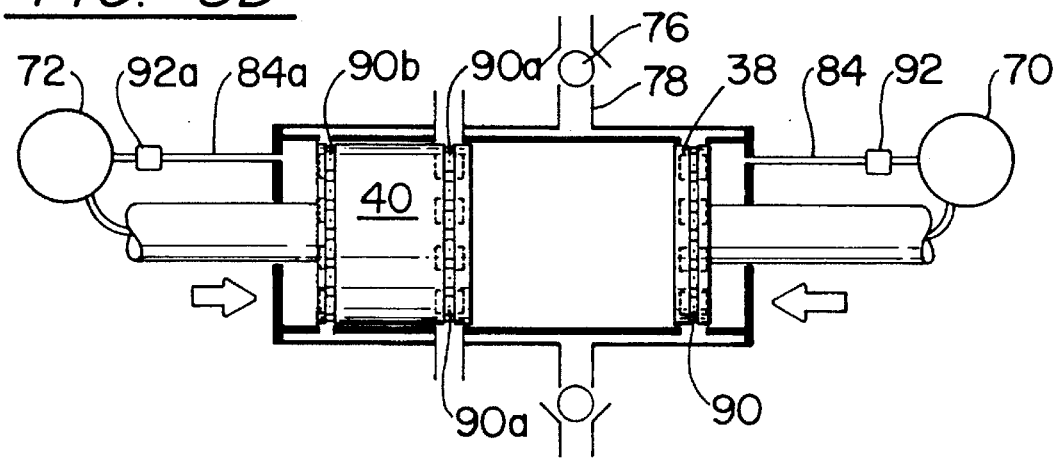
FIG. 8D is a schematic view showing the power cylinder and opposing intake and power pistons assembly in one position of the start of the compression cycle and initiation of induction of base compression air.
Figure 8E:
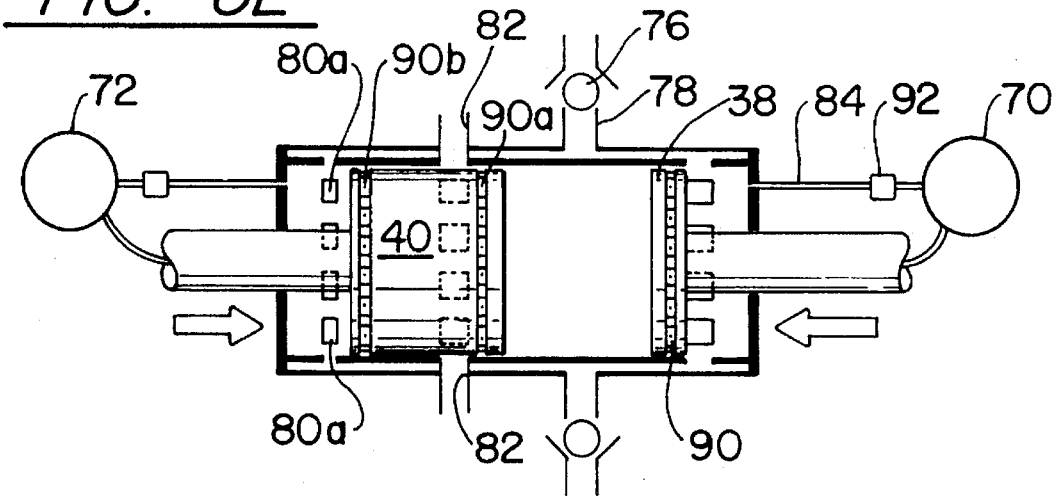
FIG. 8E is a schematic showing the power cylinder and opposing intake and exhaust pistons assembly in port closing position of the compression cycle and start of induction of base compression air.

The engine's operating cycle is best illustrated by the schematic drawings of FIGS. 8–8E where FIGS. 8–8B illustrate the power stroke cycle, FIGS. 8C is purging the power cylinder. 8D is charging the base compression and 8E illustrate the compression stroke cycle. As shown in FIG. 8 the intake and exhaust pistons are located at the top dead center of their strokes and intake piston 38 and exhaust piston 40 are at the end of the compression stroke and in the power stroke and positioned as close to each other for correct compression ratio. As is apparent from the foregoing, the air in the working portion of the power cylinder (the volume between intake and exhaust pistons) is fully compressed and fuel is timely introduced to cause an explosion forcing the pistons to separate. At this point of the cycle the inlet check valves 76 are opened since the air on the upstream and downstream sides of the check valves 76 are at the same pressure and equal to ambient pressure. Also the pressures on the back sides of intake piston 38 and exhaust piston 40 is equal to ambient pressure since they are in fluid communication with inlet 78 via the annular passage 44 and the inlet ports 80 and **80*a*. The exhaust port 82 is closed off by exhaust piston 40**.

Referring next to FIG. 8A, as both pistons are translating back toward the dead end of the stroke. i.e. bottom dead center, the inlet port 80 begins to close off by intake piston 38 and the pressures behind intake piston 38 and exhaust piston 40 increase causing the check valves 76 to close. The pressure of the combusted products between pistons (working portion of the power cylinder 36) decreases. The exhaust port 82 remains closed at this point of the cycle.

Referring next to FIG. 8B, the pistons are still moving apart and travelling toward bottom dead center and the exhaust ports 82 and inlet ports **80*a* are closed off by exhaust piston 40 and inlet ports 80 become fully closed by intake piston 38. It will be noted that the exhaust ports 82 are nearing the crack opening point. At this point of the cycle the pressure of fluid in the working portion of the power cylinder 36** is reducing to nearly its lowest value.

At the bottom dead end of the stroke as seen in FIG. 8C, the exhaust ports 82 are fully opened and the inlet ports 80 are fully opened while the inlet ports 80*a* remain closed. This scavenges or purges the working portion of cylinder 36 by allowing air trapped in annular passage 44 of the base compression cylinder to fill the power cylinder. It will be appreciated that prior to charging the power cylinder 36, the air captured in passage 44 is preheated by being in indirect heat exchange with the combustion products during the combustion process with a consequential increase in engine efficiency.

It will be noted that in FIGS. 8B and 8C the air trapped behind the intake piston 38 and exhaust piston 40 are disconnected from the inlet ports 80 and 80*a* and the exhaust ports 82. This air is completely trapped while the pistons are still in their power stroke. Hence, the power stoke further compresses this air which is forced into accumulators 70 and 72 via the fluid connections 84 and 84*a* respectively. Since the pistons are close to the end of their stroke during the remaining portion of the power stroke as is viewed in the schematics depicted in FIGS. 8B and 8C the movement of the intake and exhaust pistons create a very high pressure of remaining base compression air being fed to the accumulators 70 and 72. Hence, pressure of a small percentage of base compression air is at a value that is higher than any other pressure in the system during the entire engine operating envelope. This assures that the air used for the hydrostatic bearings is at the highest pressure of the system so that the air in the bearing pockets 88 (FIG. 10) formed in the piston rings 90, 90*a* and 90*b* (FIG. 3) will always leak out of the pockets into the power cylinder rather than vice versa and that the pressure in the pockets 88 will be sufficient to float the pistons and piston rings as will be described in the next topic. Piston rings 90, 90*a* and 90*b* are suitable conventional piston split rings modified with a plurality of air pockets to effectuate the hydrostatic bearings.

FIGS. 8D and 8E depict the compression cycle where the pistons are actuated by the power cams toward top dead center which is the transition point of the power stroke (FIG. 8). As the intake piston and exhaust piston move toward each other and pass over the inlet and exhaust ports, the air trapped in the working portion of the power cylinder compresses which causes the pressure to increase until it reaches the maximum value at the end of the stroke (top dead center). Once the pistons cross over the inlets 80 and 80*a*, the back ends of the intake pistons 38 and exhausts piston 40 remain open to the inlet pressure and since the back pressure of the check valves 78 equals the ambient pressure these check valves remain open and the back ends of the intake piston 38 and exhaust piston 40 suck in ambient air.

Check valves 92 and 92*a* are disposed in the fluid connectors 84 and 84*a* to prevent backflow from the accumulators 70 and 72. This assures that the accumulator pressure is always at the highest value in the system.

The Novotny engine lends itself to be modified to a supercharged diesel engine by a simple redesign of the power cam slope to effectuate the timing of the opening and closing of the intake port relative to the exhaust port during the compression and power cycle of the pistons. The compression slope and the expansion bearing surface power cams 46 and 48 (FIG. 6) are contoured to be slightly unsymmetrical so that when the intake and exhaust pistons move toward and away from each other the intake and exhaust port openings and closing can be different.

Figure 8G:
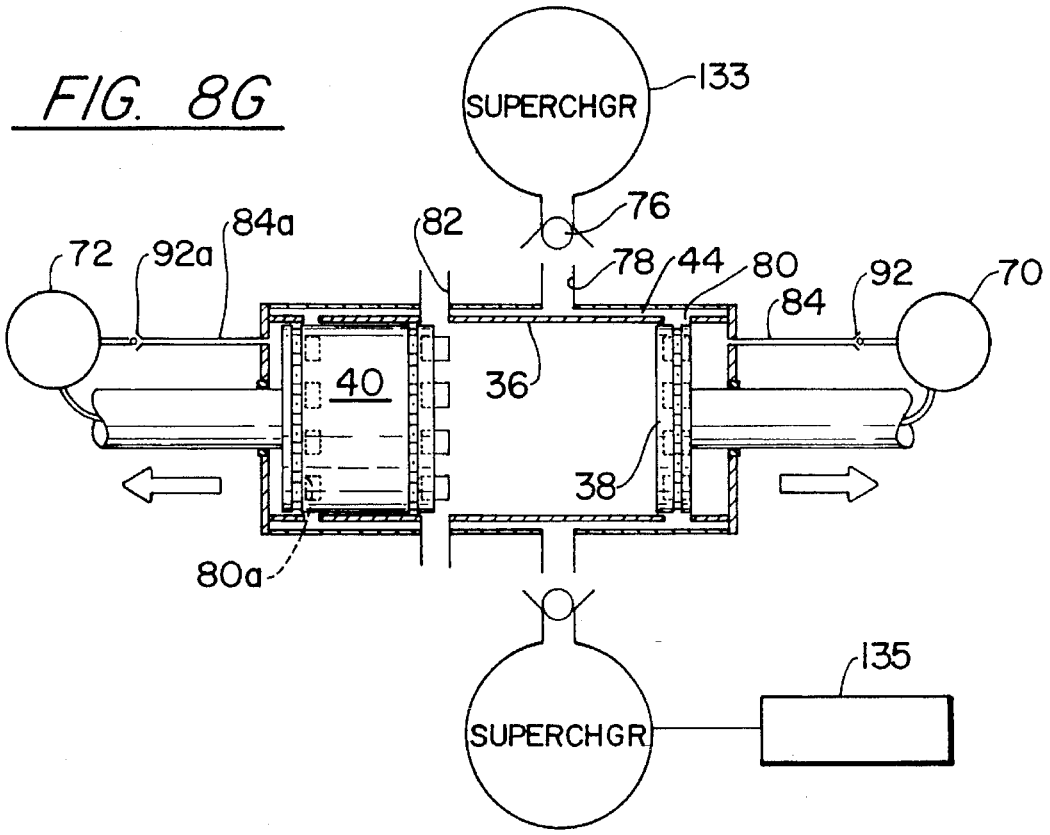
FIG. 8G is a schematic showing the power cylinder and the opposing intake and exhaust piston assembly with the cam modified to position the exhaust port open before opening the intake port in the power cycle for supercharging.
Figure 8H:
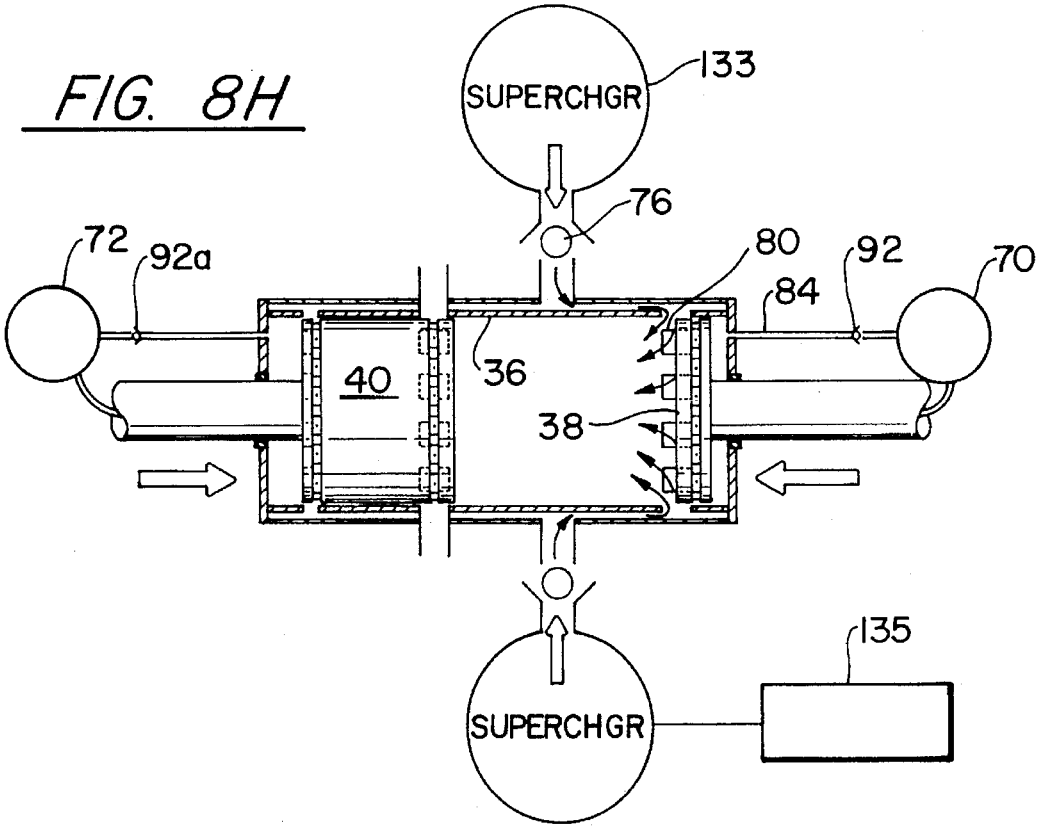
FIG. 8H is a schematic showing the power cylinder and the opposing intake and exhaust piston assembly with the cam modified to position the exhaust port closed before closing the intake port in the compression cycle for supercharging.
Figure 9:
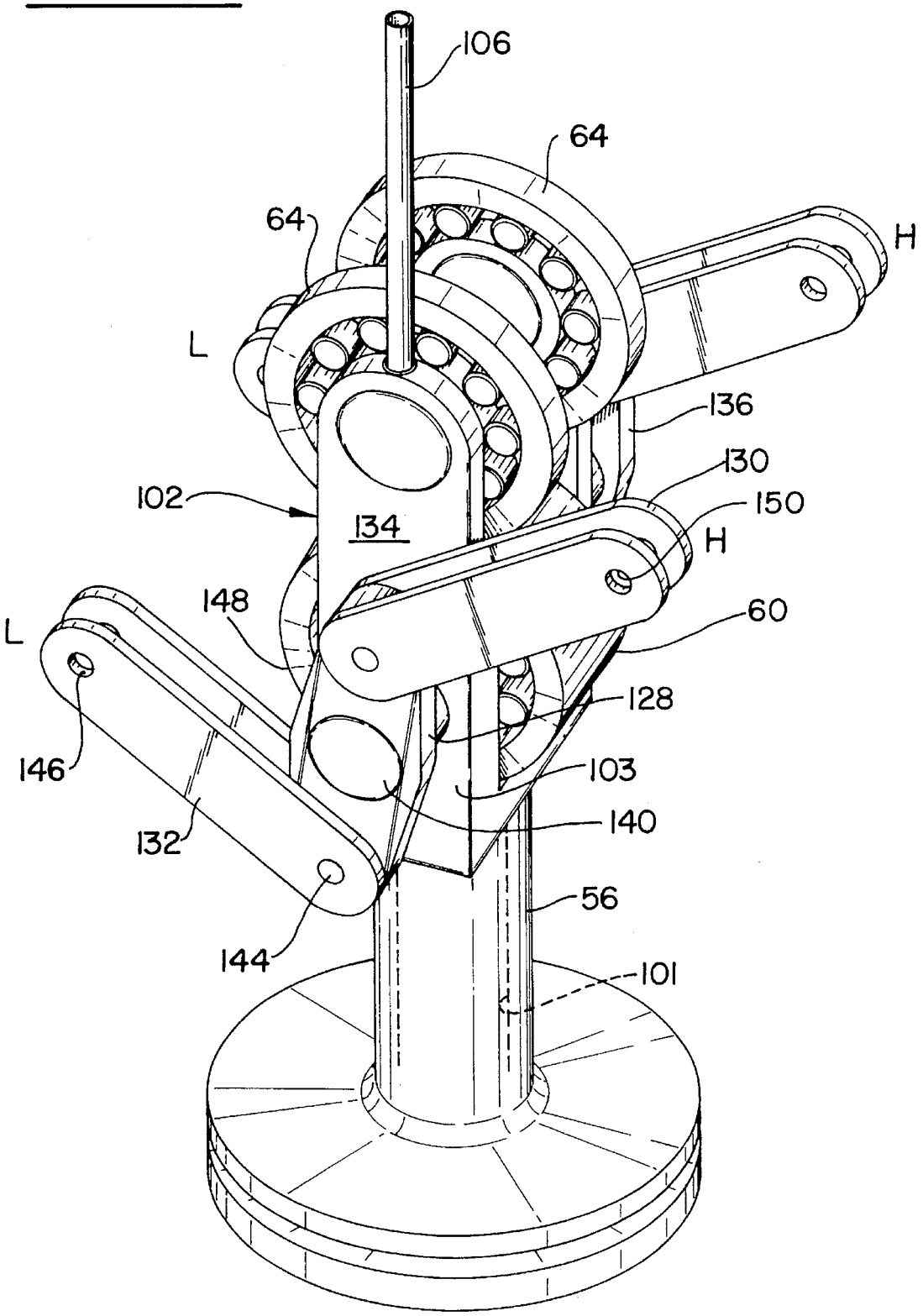
FIG. 9 is a perspective view of the intake piston assembly illustrating a portion of the four bar linkage system.

As noted in FIG. 8H which is a schematic view of the pistons when on the compression slope of the power cams, i.e. the intake and exhaust pistons are moving toward each other, the exhaust piston 40 will close the exhaust port 82 before the intake port 82 is closed by the intake piston 38. Conversely, and as noted in FIG. 8G which is a schematic identical to FIG. 8H, the pistons are now in the power slope of the power cams, such that the exhaust piston 40 will open the exhaust port 82 before the intake port 80 is opened by the intake piston 38. By having the exhaust piston 40 close the exhaust port 82 before the intake piston 38 closes the intake port 80, any increased air pressure admitted to the manifold 133 provided in a well known manner by the supercharger or turbocharger 135 will be trapped in the power cylinder and not escape out of the exhaust port 82.

It will be appreciated from the foregoing that the Novotny engine in the supercharged or unsupercharged mode, does not require valving, such as the poppet type valves used for opening and closing the intake and exhaust ports inasmuch as these ports in this engine are opened and closed by virtue of the intake and exhaust pistons.

THE HYDROSTATIC BEARINGS

Figure 10:
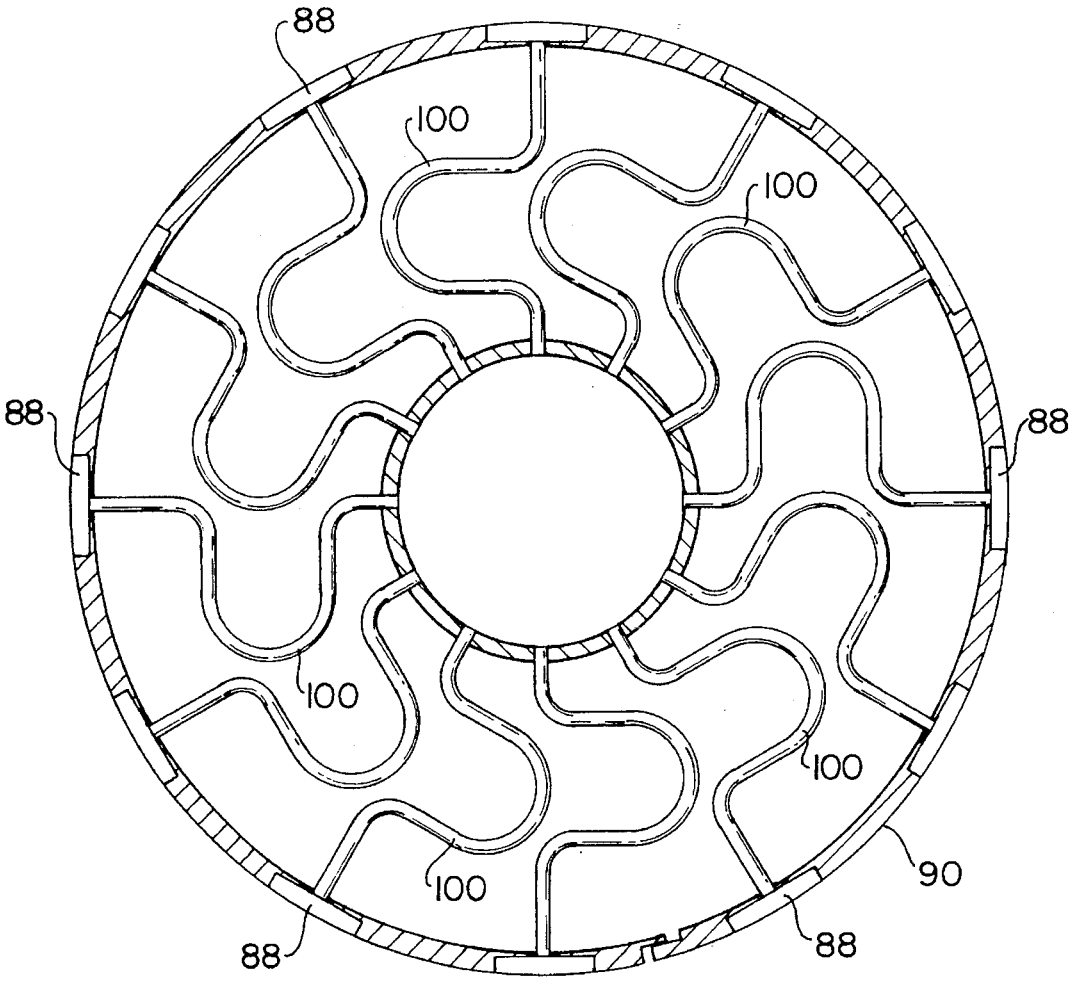
FIG. 10 is a sectional view taken along lines 10—10 of FIG. 5 showing the flexible air feed tubes and air pockets of the hydrostatic air bearing piston ring.

As best seen in FIGS. 5 and 10, the shorter intake piston 38 carries one split piston ring 90 and the larger exhaust piston carries a pair of split piston rings 90*a* and 90*b* axially spaced from each other. High pressure choked air flows from the accumulators 70 and 72 (FIG. 6) to the circumferentially spaced pockets 88 formed in each of the split rings via the small diameter flex tubes 100, the passages 103 formed in the bearing support structure 102 and 104 (see FIG. 9), the passage 101 in the hollow piston support rods 56 and 58 and the small diameter flexed tubes 106 and 108 which translate with the pistons.

The small diameter flex tubes 100 are freely mounted in a cavity formed in the piston adjacent to the piston ring annular slot 105 and extend transverse to the longitudinal axis thereof and project beyond the side surface of the piston so as fit into small apertures communicating with pockets 88 of the split piston rings 90, 90*a* and 90*b*. The exit end of the flexed tubes 100 are attached to the split rings and the inlet end of the flexed tubes are attached to the piston by suitable means such as brazing. The pockets 88 are equally spaced or arranged for optimum positioning around the circumference of the piston rings so that the air admitted thereto from the choked flow from the accumulator hydrostatically compress the piston ring relative to the cylinder and locate the piston. Each of the tubes 100 are bent in a generally U-shaped configuration and since one end is affixed to the piston and the other end is affixed to the piston ring, the pressure in the tubes will create a force that together with the hydrostatic bearing forces will space and float the piston and piston rings relative to the walls of the power cylinders. Tubes 100 are made from a suitable flexible and resilient material (either metal or a composite material) that exhibit good compliant characteristics so as to have a sufficient spring rate to properly load the piston rings as was described immediately above.

As is apparent from the foregoing the air for the hydrostatic bearings lubricate and cool the piston rings. In addition the hydrostatic bearings float the piston and piston rings which serve to minimize the side loadings. The side loadings are further eliminated by use of the four bar linkage system which will be described in the next topic immediately to follow.

THE FOUR BAR LINKAGE SYSTEM

Referring next to FIGS. 2, 3, 6, 7, 9 and 11 the opposite ends of the power cylinder 36 are sealed and located by the six raised annular ring portions 116 and 117 formed in the static end plate 110 and 112 formed in the axially spaced static end plate 112, both of which are supported to the engine case 12. The central openings 113 (one being shown) in each of the end plates 110 and 112 serve to permit the main engine shaft 14 to pass axially through the engine. Extending outwardly toward the fore end 16 and aft end 18 of the engine from the respective end plates 110 and 112 are a plurality of standups generally indicated by reference numerals 120 and 122, respectively forming a part of the four bar linkage system. As noted in FIGS. 6, 7 and 9, the four bar linkage system associated with each intake piston and exhaust piston comprise the higher standup 124, lower standup 126, the coupler 128 and links 130 and 132 (each of the links are formed from double parallel spaced plates for ease of attachment). An identical set of hardware is connected on the opposite side of the support member 102 which is bifurcated to form arms 134 and 136 and for the sake of simplicity and convenience only one set of the four bar linkage system will be described hereinbelow. Coupler 126 is connected to piston pin 140 supported in the diametrically opposed apertures formed in arms 134 and 136 for supporting the main large bearing 60. Link 132 is pivotally connected to the end of coupler 126 by pivot 144 and the other end is pivotally connected to the lower standup 126 by pivot 146 and the link 130 is connected to the opposite end of coupler 126 by pivot 148 and the opposite end is connected to the higher standup 124 by pivot 150. As noted from FIG. 7 the larger standup **124*a* is spaced opposite larger standup 124 and the lower standup 126*a* is spaced opposite the lower standup 126 to accommodate the corresponding links disposed on the arm 136**.

As will be appreciated from the foregoing, the couplers 140 and **140*a* work in unison and are torsionally interconnected by pin 140. This assures that the loads and motion are balanced on either end of pin 40. The four bar linkage system attached to each intake and exhaust piston large roller bearing piston pin guides the piston assemblies in a coordinated straight line relative to the power cylinder center line and guide the piston pin in a straight line over the 3.5 inch travel parallel to the engine shaft 14**. This straight line motion together with the hydrostatic bearings that float the pistons effectively remove all of the side loads which would otherwise occur as a result of the loads imposed by the piston and their connecting parts.

COANNULAR POWER CYLINDER AND BASE COMPRESSION CYLINDER ASSEMBLY

As was mentioned in the above paragraphs, the Novotny engine is essentially free of side loads. This feature allows the engine to be constructed without the necessity of the typically heavy block that would support the engine's cylinders. The Novotny engine consists of modules that are attached by the flanges 151, 153 and 155 (see FIG. 1), and this topic deals with the module that supports the power cylinders and base compression cylinders.

Figure 12:
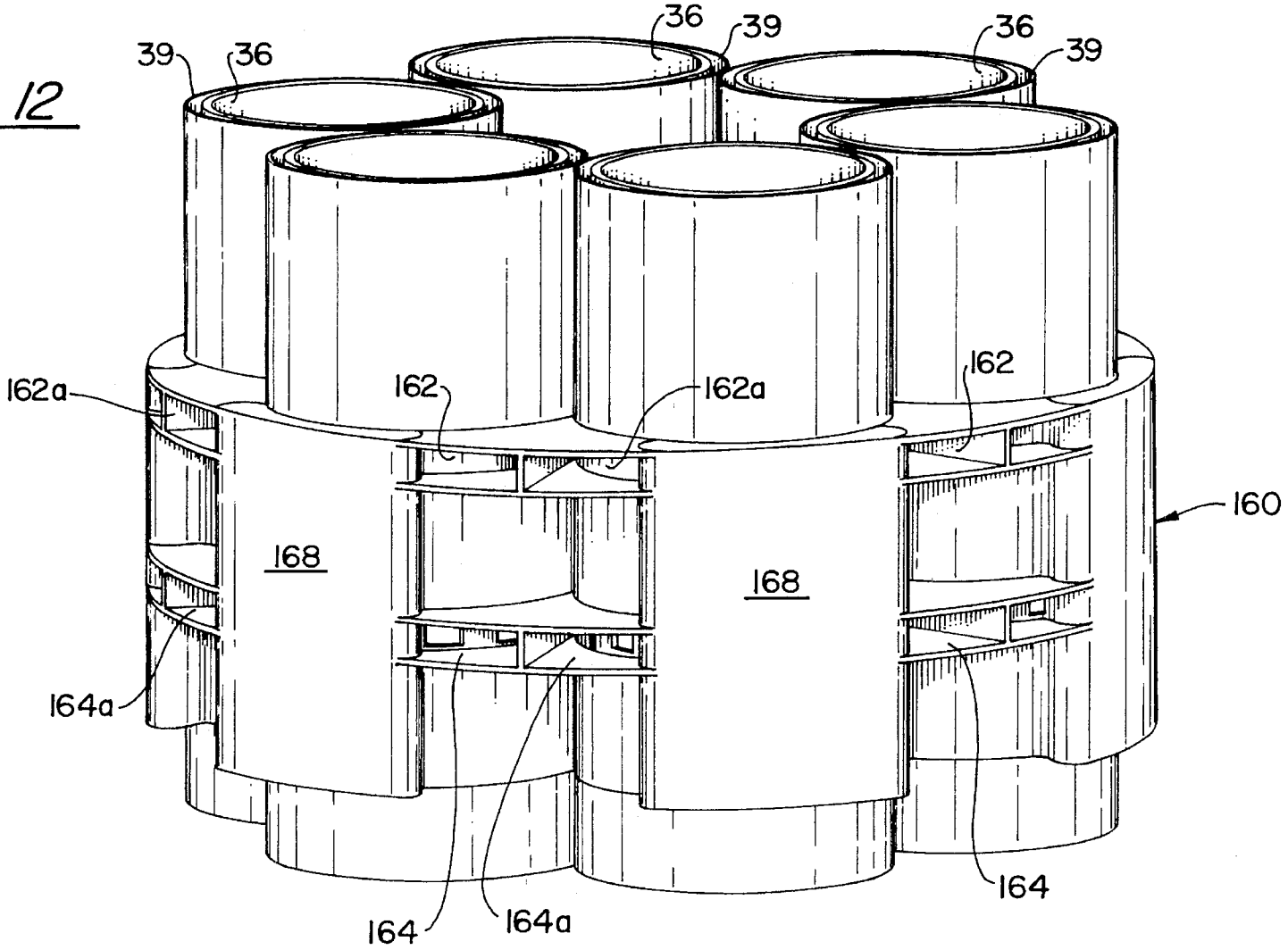
FIG. 12 is a perspective view illustrating the coannular power cylinders and base compression cylinders supported by the air jumper cylinder support structure.

Referring next to FIG. 12, the power cylinders 36 are concentrically mounted in base compression cylinders 39. The wall of the power cylinder is slightly thicker than the wall of the base compression cylinder (approximately 0.050 inch and 0.150 inch, respectively) and the six assemblies are annularly mounted (coannular). The assemblies are held together by a cylindrical band or air jumper 160 that also is made from a sheet metal material that is approximately 0.050 inch thick that is configured to define of the intake ports 162 and **162*a* and exhaust ports 164 and 164*a* associated with each of the power cylinder and base compression cylinder assemblies. The exhaust ports 164 and 164*a* are similarly constructed like the inlet ports straddling the bridge portion 168. The bridge portion 168 defines a passage for feeding the intake air to the intake ports 80 and 80*a* (FIG. 8**) that overpasses the exhaust port.

Figure 2:
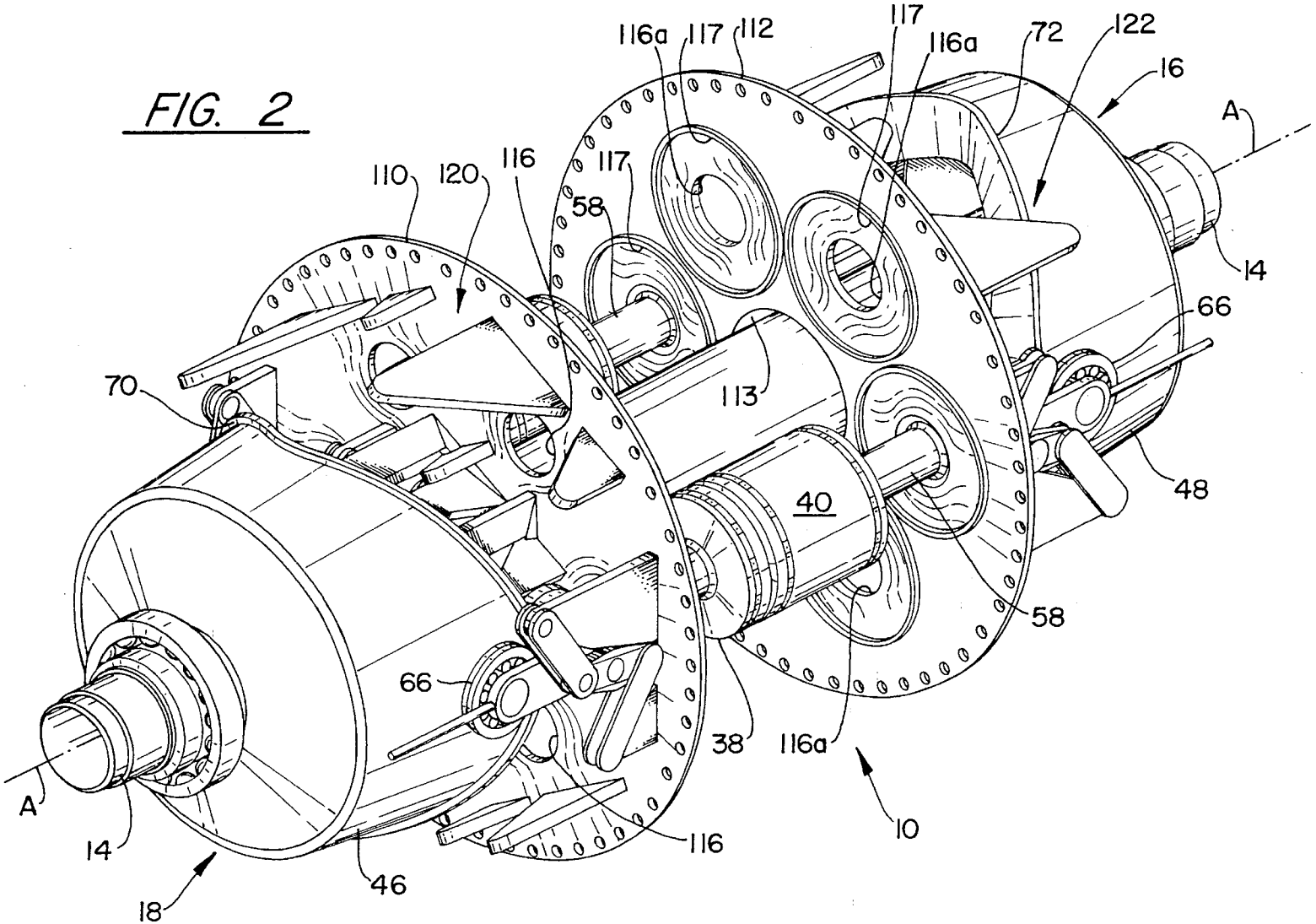
FIG. 2 is a partial view in perspective and schematic with the engine case and cylinders removed.
Figure 3:
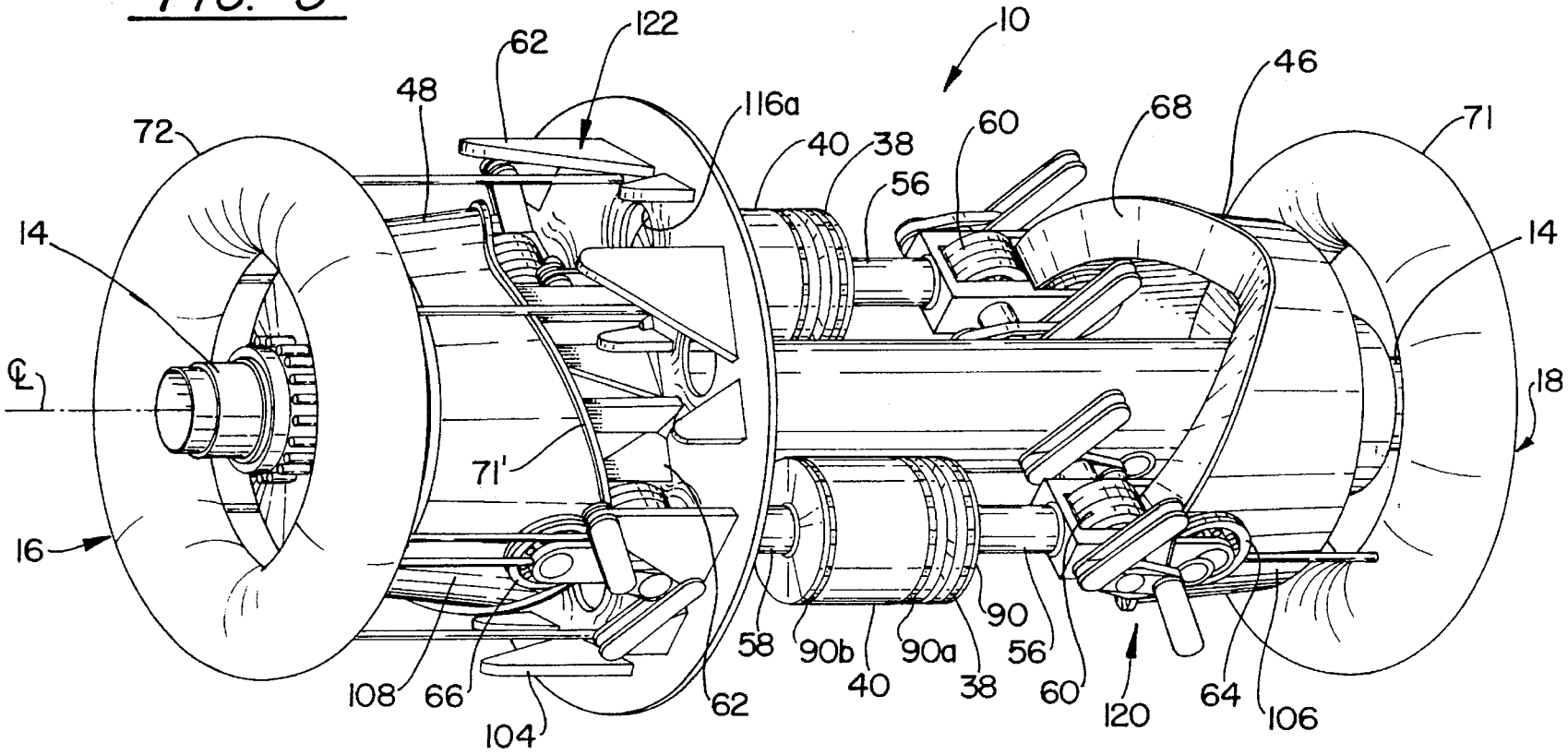
FIG. 3 is a partial side view with the engine case and cylinders removed for showing the cam, cam followers and accumulator for the air bearings.
Figure 11:
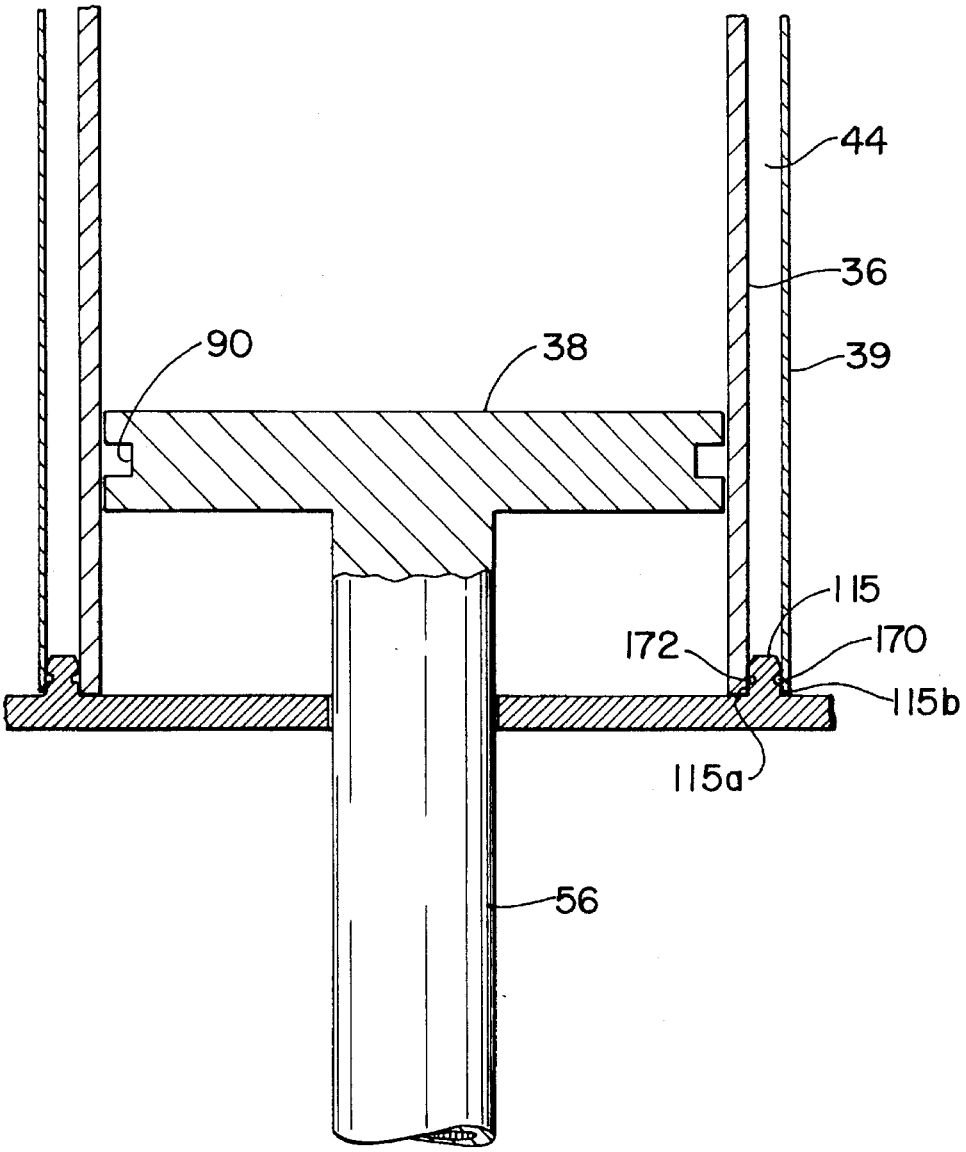
FIG. 11 is a partial view in section illustrating the base compression cylinder and the power cylinder mounted to the static end plate.

The ends of the power cylinders and base compression cylinders are supported and sealed by the opposing static end plates 110 and 112 (FIGS. 2 and 11). Since each end is identically constructed, for the sake of simplicity and convenience only one end will be described. As noted from FIG. 11 the static support member includes a raised annular ring 116 with annular side surfaces **116*a* and 116*b* (for each of the power and base compression cylinders) that bear against the surface 37 of the base compression cylinder and the outer wall of the power cylinder 36. O-rings 170 and 172 may be utilized to prevent leakage of the cylinder air and the combusted products. As noted the cylinders are sandwiched between the static end plates 110 and 112 and except for the band 160, this is the only support of the cylinders. Because the outer cylindrical case (base compression cylinder) and inner cylindrical case (power cylinder) are virtually floating members that are sandwiched between end plates 110 and 112**, this construction minimizes distortions, leakage and weight that would otherwise be evident in well known internal combustion piston engines. Since there are no side loads, it is possible to construct the cylinders without a heavy block that is typically utilized in other engines. The overall effect of this lighter engine is that it affords an extremely good power to weight ratio.

As noted from the foregoing, the Novotny engine provides a two cycle engine that has effectively removed the side loads so that the heavy support structure that would normally be required is no longer necessary. Hence, the overall power/weight ratio is increased so as to provide a more efficacious engine.

As the hydrostatic bearings will require sufficient pressure at start-up, an auxiliary power source such as an axially electric motor and air pump or pneumatic source would be necessary. For this purpose, for example, a pressure cylinder with pressurized air would be provided to accommodate the start-up. Hence, during start-up the pressure cylinder 110 would be actuated to deliver pressurized air via the attendant lines 112 to the pockets 88 in the piston rings 90, **90*a* and 90*b***. These sub-systems would ordinarily be mounted in the auxiliary case.

An advantage of the Novotny engine is that the piston top and power cylinder walls can be coated with a thermal barrier material that serves to reduce heat losses with a consequential engine efficiency improvement. The reason this is so is because the side loads are eliminated and the hydrostatic bearings float the piston and avoid metal to metal contact which would otherwise be detrimental to the thermal barrier coating.

Although this invention has been shown and described with respect to detailed embodiments thereof, it will be appreciated and understood by those skilled in the art that various changes in form and detail thereof may be made without departing from the spirit and scope of the claimed invention.

I claim:

1. An internal combustion engine including at least one outer cylindrical case defining a base compression cylinder, an inner cylindrical case concentrically disposed relative to said outer cylindrical case defining a power cylinder, opposing intake and exhaust pistons mounted in said power cylinder, at least one piston ring mounted in an annular groove formed in each of said intake piston and exhaust piston, means for hydrostatically supporting each of the piston rings and intake piston and exhaust piston to float in said power cylinder, said means including a plurality of flex tubes each having one end attached to said piston ring and an opposite end attached to each of the pistons to feed high pressure air to circumferentially spaced pockets formed in the periphery of each of said piston rings, said pockets facing the walls of said power cylinder and means including the back end of the intake piston and exhaust piston to pressurize the air in the power cylinder, and means for collecting and storing said pressurized air and being fluidly connected to said flex tubes for continuously supplying high pressure air in said pockets.

2. An internal combustion engine as claimed in claim 1 including a four bar linkage means, cam means including piston rod means attached to said intake piston and said exhaust piston for converting rectilinear motion into rotary motion, a shaft operatively connected to said cam means for extracting power from said intake piston and exhaust piston, and said four bar linkage means operatively connected to each of said piston rod means for guiding said piston rod means for substantial axial movement and axial loads and the removal of side loads.

3. An internal combustion engine as claimed in claim 1 wherein said shaft is centrally mounted and in coincidence with the axis of the engine and extends beyond the axial extremities of said outer case, whereby accessories may be attached to one end of said shaft and the load may be attached to the other end of said shaft.

4. An internal combustion engine as claimed in claim 3 including an inlet port for admitting air into said power cylinder between said intake piston and said exhaust piston, means for leading air into an annular space formed between said power cylinder and said base compression cylinder so that said air trapped in said annular space when said intake piston closes said inlet port is preheated by the combustion process in said power cylinder before being admitted into said power cylinder when said intake piston opens said intake port.

5. An internal combustion engine as claimed in claim 4 wherein said means for collecting and storing included a pair of toroidally shaped accumulators mounted on the opposite ends of said outer case.

6. An internal combustion engine as claimed in claim 5 wherein each of said flex tubes including a generally U-shaped portion formed intermediate the opposing ends of each of said flex tubes.

7. An internal combustion engine as claimed in claim 6 including a pair of base plates, one of said base plates being mounted between said cam means and said intake piston and the other of said base plated being mounted between said cam means and said exhaust piston, and said end plates including upstanding members for supporting said four bar linkage means for pivotal movement.

8. An internal combustion engine having a central shaft, a plurality of outer cylindrical cases each defining a base compression cylinder, a plurality of inner cylindrical cases each defining a power cylinder, each of said inner cylindrical cases being concentrically mounted in each of said outer cylindrical cases, each of said power cylinders and each of said base compression cylinders being circumferenctially spaced around said shaft, pairs of pistons including an intake piston and an exhaust piston mounted in each of said power cylinders and moving in opposed axial relationship with each other, at least one piston ring mounted in an annular groove formed in each of said intake and exhaust pistons, means associated with each intake piston and each exhaust piston for hydrostatically supporting the intake piston, exhaust piston and piston ring to float in each of said power cylinders, said means including a plurality of flex tubes each having one end attached to said piston ring and an opposite end attached to the associated piston to feed high pressure air to circumferentially spaced pockets formed in the periphery of each of said piston rings, said pockets facing the walls of said power cylinder and means including the back end of the intake and exhaust pistons to pressurize the air in the power cylinder, and means for collecting and storing said pressurized air and being fluidly connected to said flex tubes for continuously supplying high pressure air in said pockets.

9. An internal combustion engine as claimed in claim 8 wherein said plurality of said outer cylindrical cases and said plurality of inner cylindrical cases are each more than four in number and are of even numbers, diametrically opposed pairs of pistons being in synchronous movement relative to each other of said pairs of pistons, whereby the forces are equal and opposite to balance the load on the engine.

10. An internal combustion engine as claimed in claim 8 including a four bar linkage means, cam means including a piston rod attached to each of said intake piston and said exhaust piston for converting rectilinear motion into rotary motion, a shaft operatively connected to said cam means for extracting power from said intake and exhaust pistons, and said four bar linkage means operatively connected to each of said piston rods for guiding said piston rod for substantial axial movement and loads.

11. An internal combustion engine as claimed in claim 10 including an inlet port for admitting air into said power cylinder between said intake piston and said exhaust piston, means for leading air into an annular space formed between said power cylinder and said base compression cylinder so that said air trapped in said annular space when said intake piston closes said inlet port is preheated by the combustion process in said power cylinder before being admitted into said power cylinder when said intake piston opens said intake port.

12. An internal combustion engine as claimed in claim 11 wherein said means for collecting and storing included a pair of toroidally shaped accumulators mounted on the opposite ends of said outer case.

13. An internal combustion engine as claimed in claim 12 wherein each of said flex tubes including a generally U-shaped portion formed intermediate the opposing ends of each of said flex tubes.

14. An internal combustion engine as claimed in claim 13 including a pair of base plates, one of said base plates being mounted between said cam means and said intake piston and the other of said base plated being mounted between said cam means and said exhaust piston, and said end plates including upstanding members for supporting said four bar linkage means for pivotal movement.

15. An internal combustion engine as claimed in claim 8 including means for admitting fuel into said power cylinder between said intake piston and exhaust piston.

16. An internal combustion engine having an outer cylindrical case defining a base compression cylinder, an inner cylindrical case concentrically mounted in said outer cylindrical case, a plurality of even number of power cylinders and base compression cylinders coannularly mounted in said engine, pairs of pistons including an intake piston and an exhaust piston mounted in each of said power cylinders and moving in opposed axial relationship with each other, diametrically opposed pairs of pistons being in synchronous movement relative to each other of said pairs, a shaft extending through said outer cylindrical case and being in coincidence with the axis of rotation, a pair of axially spaced cams attached to opposite end portions of said shaft and rotating therewith, a pair of axially spaced static disks mounted in a plane transverse to the engine's axis and disposed between said power cylinders for supporting and closing the ends thereof and each of said pair of cams, means including a piston rod attached to each of said intake pistons and one of said cams of said pair of cams and to each of said exhaust pistons and the other of said cams of said pair of cams, each of said static disks including a plurality of first stand-up posts extending axially facing the immediate extremity of said outer case and a plurality of second smaller stand-up posts axially facing the immediate extremity of said outer case, each of said first posts and said second posts being in complementary relationship with each of said piston rods, linkage means pivotally attached to each of said piston rods and each of said first post and said second posts to define a four bar linkage system, whereby the side loads of the rectilinear movement of said piston rods and the attendant intake piston and exhaust piston is minimized.

17. An internal combustion engine as claimed in claim 16 wherein each of said piston rods includes a bifurcated end portion, an axle supported to said bifurcated end portion and extending in a plane transverse to said axis, a large roller attached rotary supported to said axle for bearing against the cam for imparting rotary motion thereto, each of said static disks including a plurality of third standup posts extending axially facing the immediate extremity of said outer case and a plurality of fourth smaller stand-up posts axially facing the immediate extremity of said outer case, each of said third posts and said fourth posts being attached to said axle on the opposite end of said axle, each of said third posts and said second posts being in complementary relationship with each of said piston rods, additional linkage means pivotally attached to each of said piston rods and each of said third posts and said fourth posts to define an additional four bar linkage system and are torsionally interconnected by said axle so as to operate in unison with said first post and said second post.

18. An internal combustion engine as claimed in claim 17 wherein said four bar linkage includes a plurality of coupler linkages attached intermediate the ends thereof to said axle and a first link pivotally attached at one end to one end of said coupler and pivotally attached at one end to each of said first posts, and a second link pivotally attached at an opposite end of said coupler and pivotally attached at the opposite end to each of said second posts.

19. An internal combustion engine as claimed in claim 18 wherein said additional four bar linkage system includes an additional coupler attached to said axle, a third link pivotally attached at one end to one end of said additional coupler and pivotally attached at one end to each of said third posts, and a fourth link pivotally attached at an opposite end of said additional coupler and pivotally attached at the opposite end to each of said fourth posts.

20. An internal combustion engine as claimed in claim 19 including at least one piston ring mounted in an annular groove formed in each of said intake pistons and exhaust pistons, means for hydrostatically supporting each of the piston rings and intake pistons and exhaust pistons to float in each of said power cylinders, said means including a plurality of flex tubes each having one end attached to said piston ring and an opposite end attached to the associated piston to feed high pressure air to circumferentially spaced pockets formed in the periphery of each of said piston rings facing the walls of said power cylinder and means including the back end of the intake and exhaust pistons to pressurize the air in the power cylinder, and means for collecting and storing said pressurized air and being fluidly connected to said flex tubes for continuously supplying high pressure air in said pockets.

21. An internal combustion engine as claimed in claim 20 wherein said shaft is centrally mounted and in coincidence with the axis of the engine and extends beyond the axial extremities of said outer case, whereby accessories may be attached to one end of said shaft and the load may be attached to the other end of said shaft.

22. An internal combustion engine as claimed in claim 21 including an inlet port for admitting air into said power cylinder between said intake piston and said exhaust piston, means for leading air into an annular space formed between said power cylinder and said base compression cylinder so that said air trapped in said annular space when said intake piston closes said inlet port is preheated by the combustion process in said power cylinder before being admitted into said power cylinder when said intake piston opens said intake port.

23. An internal combustion engine as claimed in claim 22 wherein said means for collecting and storing included a pair of toroidally shaped accumulators mounted on the opposite ends of said outer case.

24. An internal combustion engine as claimed in claim 23 wherein each of said flex tubes including a generally U-shaped portion formed intermediate the opposing ends of each of said flex tubes.

25. An internal combustion engine as claimed in claim 24 including fuel delivery means for sequentially admitting fuel into said power cylinder between said intake piston and said exhaust piston during the power stroke cycle.

26. An internal combustion engine having an outer cylindrical case defining a base compression cylinder, an inner cylinder concentrically mounted in said outer cylindrical case defining a power cylinder, a plurality of even number of power cylinders circumferenctially spaced in said engine, pairs of pistons including an intake piston and an exhaust piston mounted in each of said power cylinders and moving in opposed axial relationship with each other, each piston being in synchronous movement relative to the other of said pairs, a shaft extending through said outer cylindrical case and being in coincidence with the axis of rotation, a pair of axially spaced cams attached to opposite end portions of said shaft and rotating therewith, a pair of axially spaced static disks mounted in a plane transverse to the engine's axis and disposed between said power cylinders and each of said pair of cams, means including a piston rod attached to each of said intake pistons and one of said cams of said pair of cams and to each of said exhaust pistons and the other of said cams of said pair of cams, each of said static disks including a plurality of first stand-up posts extending axially facing the immediate extremity of said outer case and a plurality of second smaller stand-up posts axially facing the immediate extremity of said outer case, each of said first posts and said second posts being in complementary relationship with each of said piston rods, linkage means pivotally attached to each of said piston rods and each of said first posts and said second posts to define a four bar linkage system, at least one piston ring mounted in an annular groove formed in each of said intake pistons and exhaust pistons, means for hydrostatically supporting each of the piston rings and intake pistons and exhaust pistons to float in each of said power cylinders, said means including a plurality of flex tubes each having one end attached to said piston ring and an opposite end attached to the associated piston to feed high pressure air to circumferentially spaced pockets formed in the periphery of each of said piston rings facing the walls of said power cylinder and means including the back end of the intake and exhaust pistons to pressurize the air in the power cylinder, and means for collecting and storing said pressurized air and being fluidly connected to said flex tubes for continuously supplying high pressure air in said pockets, whereby the side loads of the rectilinear movement of said piston rods and the attendant intake piston and exhaust piston is minimized.

27. An internal combustion engine as claimed in claim 26 wherein said four bar linkage includes a plurality of coupler linkages attached intermediate the ends thereof to said axle and a first link pivotally attached at one end to one end of said coupler and pivotally attached at one end to each of said first posts and a second link pivotally attached at an opposite end of said coupler and pivotally attached at the opposite end to each of said second posts.

28. An internal combustion engine as claimed in claim 27 wherein said additional four bar linkage system includes an additional coupler attached to said axle, a third link pivotally attached at one end to one end of said additional coupler and pivotally attached at one end to each of said third posts, and a fourth link pivotally attached at an opposite end of said additional coupler and pivotally attached at the opposite end to each of said fourth posts.

29. An internal combustion engine as claimed in claim 28 including at least one piston ring mounted in an annular groove formed in each of said intake pistons and exhaust pistons, means for hydrostatically supporting each of the piston rings and intake pistons and exhaust pistons to float in each of said power cylinders, said means including a plurality of flex tubes each having one end attached to said piston ring and an opposite end attached to the associated piston to feed high pressure air to circumferentially spaced pockets formed in the periphery of each of said piston rings facing the walls of said power cylinder and means including the back end of the intake and exhaust pistons to pressurize the air in the power cylinder, and means for collecting and storing said pressurized air and being fluidly connected to said flex tubes for continuously supplying high pressure air in said pockets.

30. An internal combustion engine as claimed in claim 29 wherein said shaft is centrally mounted and in coincidence with the axis of the engine and extends beyond the axial extremities of said outer case, whereby accessories may be attached to one end of said shaft and the load may be attached to the other end of said shaft.

31. An internal combustion engine as claimed in claim 30 including an inlet port for admitting air into said power cylinder between said intake piston and said exhaust piston, means for leading air into an annular space formed between said power cylinder and said base compression cylinder so that said air trapped in said annular space when said intake piston closes said inlet port is preheated by the combustion process in said power cylinder before being admitted into said power cylinder when said intake piston opens said intake port.

32. An internal combustion engine as claimed in claim 30 wherein said means for collecting and storing included a pair of toroidally shaped accumulators mounted on the opposite ends of said outer case.

33. An internal combustion engine as claimed in claim 30 wherein each of said flex tubes including a generally U-shaped portion formed intermediate the opposing ends of each of said flex tubes.

34. An internal combustion engine as claimed in claim 33 including a four bar linkage means, cam means including piston rod means attached to each of said intake piston and said exhaust piston for converting rectilinear motion into rotary motion, a shaft operatively connected to said cam means for extracting power from said intake piston and exhaust piston, and said four bar linkage means operatively connected to each of said piston rod means for guiding said piston rod means for substantial axial movement and axial loads and the removal of side loads.

35. An internal combustion engine as claimed in claim 34 wherein said shaft is centrally mounted and in coincidence with the axis of the engine and extends beyond the axial extremities of said outer case, whereby accessories may be attached to one end of said shaft and the load may be attached to the other end of said shaft.

36. An internal combustion engine as claimed in claim 35 including an inlet port for admitting air into said power cylinder between said intake piston and said exhaust piston, means for leading air into an annular space formed between said power cylinder and said base compression cylinder so that said air trapped in said annular space when said intake piston closes said inlet port is preheated by the combustion process in said power cylinder before being admitted into said power cylinder when said intake piston opens said intake port.

37. An internal combustion engine as claimed in claim 36 wherein said means for collecting and storing included a pair of toroidally shaped accumulators mounted on the opposite ends of said outer case.

38. An internal combustion engine as claimed in claim 37 wherein each of said flex tubes including a generally U-shaped portion formed intermediate the opposing ends of each of said flex tubes.

39. An internal combustion engine as claimed in claim 38 including a pair of base plates, one of said base plates being mounted between said cam means and said intake piston and the other of said base plated being mounted between said cam means and said exhaust piston, and said end plates including upstanding members for supporting said four bar linkage means for pivotal movement.

40. An internal combustion engine as claimed in claim 39 including means for initiating startup of said engine including a source of pressurized air and means for fluidly interconnecting each of said pockets to said source.

41. An internal combustion engine as claimed in claim 40 including means for supercharging said engine, said means including a slope on said cam for timing the opening and closing of the intake port relative to the exhaust port formed in said power cylinder for a half revolution of said cam and a different slope on said cam for changing the timing of the opening and closing of the intake port relative to the exhaust port during the second half of each revolution of said cam.

* * * * *